US006349968B1

(12) United States Patent
Crego et al.

(10) Patent No.: US 6,349,968 B1
(45) Date of Patent: Feb. 26, 2002

(54) TEMPORARY HOLD-UP DEVICE FOR SNOWBOARD SUPPORT

(76) Inventors: Anthony Crego, 2581 Lakewood-Allenwood Rd., Howell, NJ (US) 07731; Daniel Slocum, 344 Forest Dr., Neptune, NJ (US) 07753

( * ) Notice: Subject to any disclaimer, the term of this patent is extended or adjusted under 35 U.S.C. 154(b) by 444 days.

(21) Appl. No.: 08/888,967

(22) Filed: Jul. 7, 1997

(51) Int. Cl.[7] ..... A63C 11/00
(52) U.S. Cl. ..... 280/809; 24/265 H; 24/302
(58) Field of Search ..... 280/809, 814, 280/637; 24/298, 300, 301, 302, 265 H, 265 CD, 265 BC, 265 EC

(56) References Cited

U.S. PATENT DOCUMENTS 548,027 A * 10/1895 Bernhard ..... 379/448
4,013,318 A * 3/1977 Piper ..... 297/438
4,556,252 A * 12/1985 Serex ..... 297/438
5,438,736 A * 8/1995 Terada et al. ..... 24/599.8
5,546,639 A * 8/1996 Lacore et al. ..... 24/265 H
5,564,729 A * 10/1996 Gomez et al. ..... 280/637
5,653,467 A * 8/1997 Griffin et al. ..... 280/809
5,913,479 A * 6/1999 Westwood, III ..... 24/298
5,951,048 A * 9/1999 Slaughter ..... 280/814

* cited by examiner

*Primary Examiner*—J. J. Swann
*Assistant Examiner*—David R. Dunn
(74) *Attorney, Agent, or Firm*—Charles I. Brodsky

(57) ABSTRACT

A temporary hold-up device for a snowboard support while riding a chairlift including a substantially stiff cord of limited give, at a first end of which a releasable clasp is provided to encircle the restraint bar of the chairlift, while at a second opposite end of which a hook is provided to couple to a rear binding of one of the front and back foot mountings of the snowboard, and by which the restraint bar serves to hold and restrain the snowboard against flapping about while the riding is pulled up the lift.

5 Claims, 2 Drawing Sheets

TEMPORARY HOLD-UP DEVICE FOR SNOWBOARD SUPPORT

FIELD 0F THE INVENTION

This invention relates to the sport of snowboarding, in general, and to an arrangement for supporting the weight of a snowboard while riding up a chairlift, in particular.

BACKGROUND OF THE INVENTION

As is well known and understood, snowboarding is one of the fastest, if not the fastest growing sport today. With it, as is known, the front foot of the participant is always secured in place by the binding of the front mount of the board, while the rear foot of the participant is secured in place at the back mount when utilizing the snowboard, but is freed from it while riding a chairlift back up the mountain. During those occasions, however, problems can result. For example, the participant riding the lift can either support the snowboard with the foot free from the mount; or could just let the snowboard hang by the foot secured in the front mounting. The situation that develops, however, is that with the participant twenty feet up in the air, riding up the chairlift, winds typically abound, of an extent to thrash the snowboard about. In the case where the snowboard is supported by the free foot, this often results in injuries to the toes supporting the board. In the case where the snowboard is hanging freely, the encountered winds thrashing the board about often have the tendency to cause injury to the ligaments, tendons and muscles of the front foot bound in the mounting. Obviously, furthermore, even where headwinds are not encountered, just the weight of the snowboard itself has a tendency to pull on the ligaments, tendons, muscles, etc., causing damage over time—with the enhanced possibility of that occurring at the end of the day after the participant's leg has tired through hours of activity. Experience has shown that even with snowboards made of fiberglass or similar resins—weighing of the order of 10–15 lbs.—there results this undesired pulling on the tendons, ligaments and muscles producing a stress which it would be desirable to reduce, and to the extent possible, eliminate.

OBJECTS OF THE INVENTION

It is an object of the present invention, therefore, to provide a new and improved arrangement for supporting the weight of a snowboard while riding up the mountain on a chairlift.

It is an object of the present invention, also, to provide such an arrangement which can be easily deployed for use, and released upon reaching the top of the mountain.

It is another object of the present invention to provide such an arrangement which can be easily attached at the beginning of the chairlift ride, and which can be just as easily detached at the end of it, with the arrangement then being able to be simply carried about in one's pocket.

It is a further object of the invention to provide such an arrangement for snowboard use which requires virtually no modification whatsoever to the equipment being used, in order that it can be immediately deployed for use, without any alteration of the snowboarding equipment utilized by the participant.

It is yet another object of the invention to provide such an arrangement which can be utilized for all sizes of snowboards in use, for all types of configurations employed, and for all users of no matter what their skill levels may be, without having to modify the equipment already possessed.

SUMMARY OF THE INVENTION

As will become clear from the following description, a temporary hold-up device for snowboard support while riding a chair lift includes a substantially stiff cord of limited give, at a first end of which a releasable clasp is provided to encircle the restraint bar of the chairlift, while at a second opposite end of which a hook is provided to couple to a rear binding of one of the front and back foot mountings on the snowboard, by which the restraint bar serves to hold and restrain the snowboard against flopping about. As will be seen, in a preferred embodiment, the hook is provided with a substantially U-shape opening to slide under a rear binding of the back foot mounting, while the releasable clasp includes a spring-loaded gate biased to a quiescent closed position—but which is openable in response to a momentary force temporarily applied to deflect the gate away from that quiescent closed point. By fabricating the hook of a heavy duty plastic composition, and by fabricating the clasp of a heavy duty metal composition, a relatively inexpensive cord can be had, and whose substantial stiffness, with limited give, serves to utilize the restraint bar of the chairlift to support the weight of the snowboard. Whereas analysis has shown that the substantially stiff cord could join to either the rear binding on the front or back mounting, securing it to the rear binding of the back mounting is preferable, in that the other, free foot, could then rest atop the snowboard while the participant is riding up the mountain. In such arrangement, the snowboard then becomes a "rest" for the free foot, while the restraint bar supplies all the support for the snowboard, freeing the front foot from any stress, tension, or undue pull on its tendons, ligaments and muscles.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
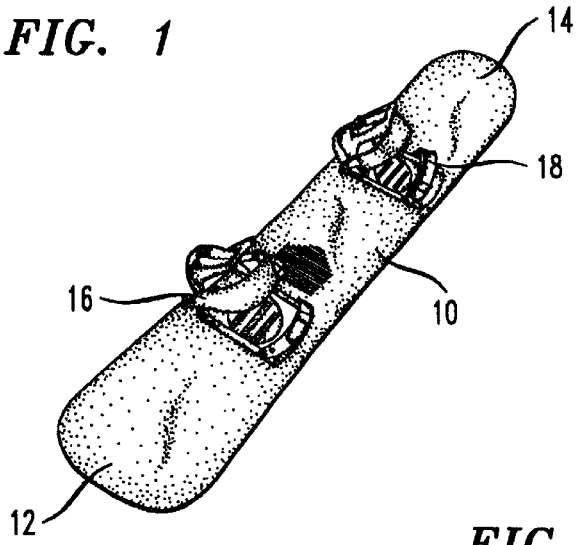
FIG. 1 illustrates a snowboard of typical design, in connection with which the temporary hold-up device of the present invention is particularly attractive.
Figure 3:
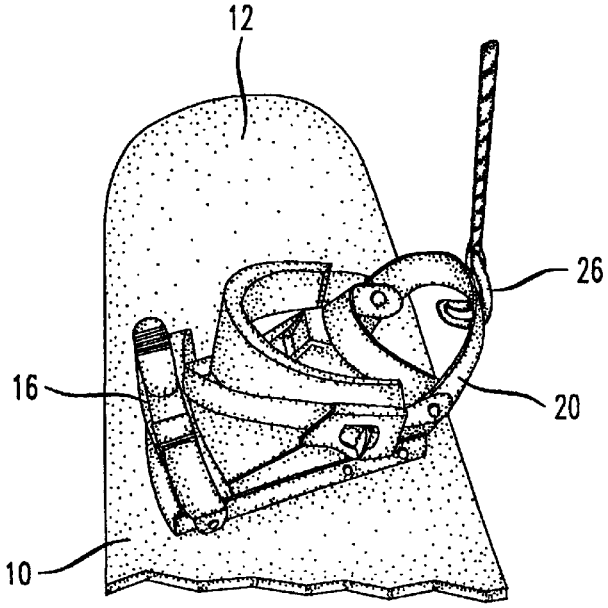
FIGS. 3 and 4 illustrate the manner of coupling the hook of the cord to the rear binding of the back foot mount of the snowboard.
Figure 4:
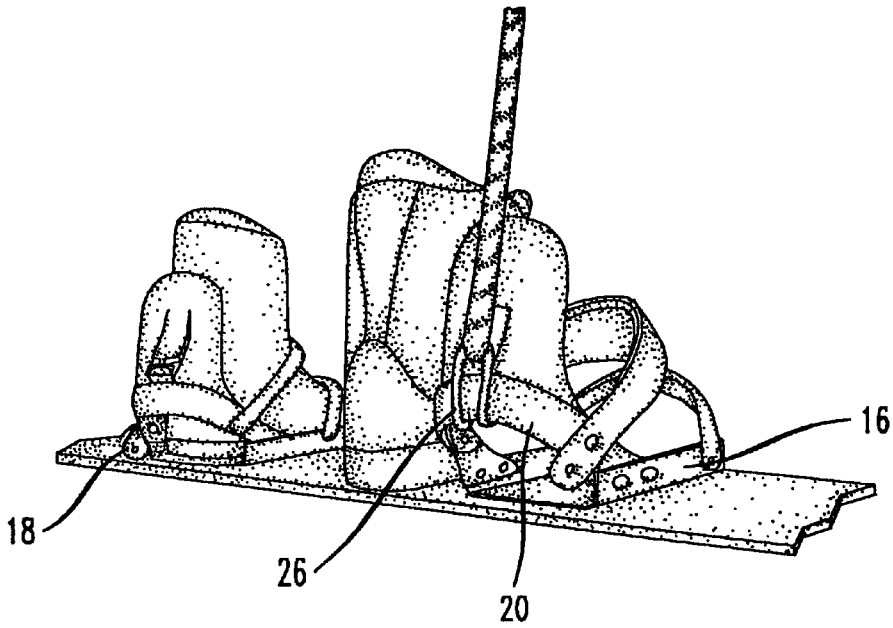

In FIGS. 1 and 3–4, the snowboard of the invention is shown at 10, having a rear end 12 and front end 14. A pair of foot mounts 16 and 18 are shown, with the foot mount 16 being closer to the rear end 12 of the snowboard 10, and with the foot mount 18 being closer to the front end 14 of the snowboard 10. Any appropriate type of foot mount may be employed, and typically are characterized by bindings which secure about the foot once in position, and with the mount being secured to the snowboard itself. As will be appreciated by those skilled in the art, correct use of the snowboard entails the secured placement of the front foot of the participant in the front mounting 18, and with the rear foot placed in the back mounting 16 during use, but with the rear foot being removed from the mounting 16 while riding the chairlift up the mountain. As more particularly shown in FIGS. 3 and 4, the back mounting 16 includes a binding strap 20 at its rear, which typically is some 1 inch wide, and which is intended to encircle the heel of the rider.

Figure 2:
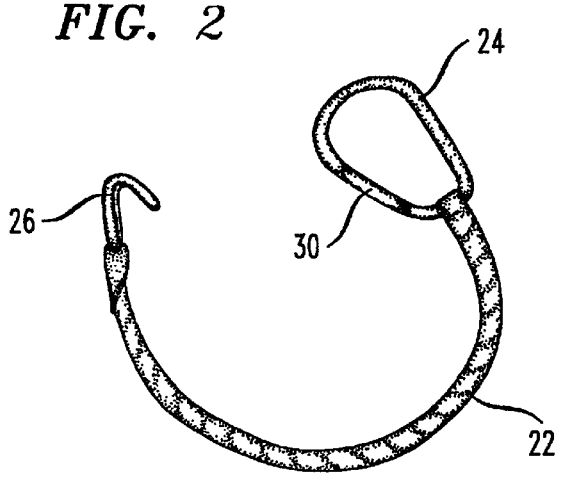
FIG. 2 is an illustration of the substantially stiff cord, of limited give, with the hook and clasp attached, constructed in accordance with a preferred embodiment.

As shown in FIG. 2, a temporary hold-up device for supporting the snowboard in accordance with the invention includes a substantially stiff cord of limited give 22, a releasable clasp 24 at a first end, and a substantially U-shaped hook 26 at its opposite end. Preferably fabricated of a heavy duty plastic, the hook 26 is configured to slide under the binding strip 20 of the back mount 16, and to be held in place there (see FIGS. 3 and 4). By so fabricating the cord 22 and the hook 26, any upward pull on the cord 22 thus pulls along with it the snowboard 10, and by means of the back mounting 16 secured to the board.

Figure 5:
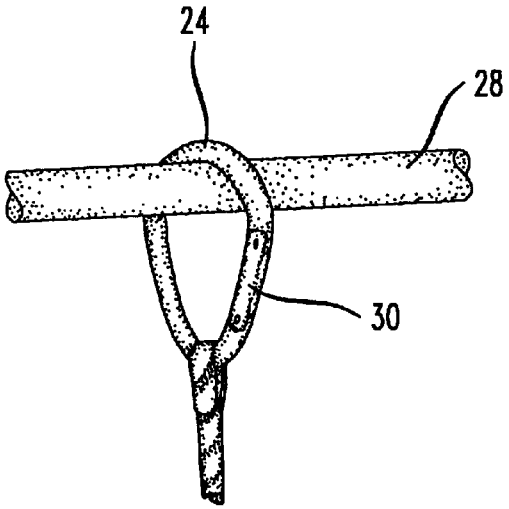
FIG. 5 illustrates how the clasp of the hold-up device encircles the restraint bar of the chairlift in use.

As shown in FIG. 2—and also as shown in FIG. 5—the clasp 24 is of an opening large enough to encircle the restraint bar of the chairlift when in use, shown as 28 in FIG. 5. In accomplishing this, the clasp 24 includes a spring-loaded gate 30 shown in FIGS. 2 and 5 as being biased to a quiescent closed position. However, in accordance with the teachings of the invention, such gate 30 is openable in response to a momentary force temporarily applied to it, in a direction to deflect the gate inwardly to the opening, away from the quiescent closed position shown in FIGS. 2 and 5. Thus, and referring to FIG. 5, a momentary inward finger pressure upon the gate 30 moves the gate inwardly of the opening which encircles the restraint bar 28, and by a sufficient amount so that the clasp is releasable from the bar. Conversely, having the clasp apart from the bar 28, as shown in FIG. 2, a momentary force (as by pressing the bar against the gate 30) itself opens the gate 30 to allow the clasp to be placed back encircling the bar 28 once more.

In operation of the invention, when the rider sits on the chairlift, he or she simply need reach down to slide the hook 26 under the binding strap 20 to grasp the back mounting bracket 16, and simply force the gate 30 of the clasp 24 against the restraint bar 28, tying the temporary hold-up device in its snowboard supporting position. Later, when it is desired to release the support, all that the participant need do is to reach again to slide out this time the hook 26 from the binding strap 20, and to then press in the gate 30 enabling the restraint bar 28 to be released from the clasp 24. With the cord 22, the hook 26 and the clasp 24 in position, it will be readily appreciated by those skilled in the art that the restraint bar 28, itself, serves to support the weight of the snowboard 10, without any need for its further support by the toes of the free foot, and without it dangling in the wind. To such end, a cord 22 of some 26–28 inches has been found to be most suitable for adults of varying height.

Obviously, and in accordance with the invention, the temporary hold-up device of the cord 22, the clamp 24 and the hook 26 could be connected to couple to the rear binding strip on the front foot mount 18. Although the invention will operate equally as well, such an alternative arrangement is not as desirable, as it would require the participant to essentially keep what was previously his or her "free foot" now fast in the back mounting 16. Experience has shown that with this rear foot free, able to be moved about, and able to be rested on the snowboard when the snowboard is supported by the hold-up device of the invention, the arrangement enables freer circulation of the blood in that foot, and makes it easier for the participant to use the snowboard for longer periods of time without increasing the stress which many hours of snowboarding often produces.

In carrying out the teachings of the invention, furthermore, experience has shown that one type of cord which offers highly desirable characteristics in operation is that employed in "mountaineering". There, such cord has limited bounce or springiness, it's strong and it's durable. As will be appreciated, one purpose of the hold-up device is to support the snowboard, and an undue degree of "bounce", would permit the snowboard to move about in the wind, to unnecessarily stress the muscles, ligaments and joints. In similar fashion, the clasp of the invention has been found to work perfectly as well when employing a quick-release snap-type of hook as employed in kyaking. There, such clasp is found to be of large enough opening as to encircle the restraint bar, and to be easily and quickly openable and biasably closable.

While there have been described what are considered to be preferred embodiments of the present invention, it will be readily appreciated by those skilled in the art that modifications can be made without departing from the scope of the teachings herein of utilizing the restraint bar of the chairlift to support the snowboard in a simple manner, rather than to do so with the free foot, or to just let the snowboard hang in the wind. In like manner, it will be appreciated that the invention could operate equally as well with a carving board arrangement, which also is a fast growing winter sport, instead of with a snowboard, and the invention should be read in that light, also. For at least such reason, therefore, resort should be had to the claims appended hereto for a true understanding of the scope of the invention.

We claim:

1. The combination comprising:

a chairlift having a seat and a restraint bar;

a snowboard having front and back foot mountings;

a substantially stiff cord;

a hook means at one end of said cord for coupling to a rear binding of one of said front and back foot mountings, said hook means being configured to slide under said binding to be held in place thereat; and a clasp at an opposite end of said cord for coupling to said restraint bar of said chairlift, with said clasp being configured to encircle said restraint bar when closed;

with said substantially stiff cord being of limited give and springiness by which said restraint bar of said chairlift serves to support the weight of said snowboard when said clasp is closed and to restrain said snowboard against moving about in wind;

and with said clasp being releasable to detach from said restraint bar when opened where support for said snowboard is not needed.

2. The combination of claim 1 wherein said hook means is provided with a substantially U-shape opening to slide under a rear binding of said back foot mounting.

3. The combination of claim 1 wherein said clasp means includes a spring-loaded gate biased to a quiescent closed position, and openable in response to a momentary force temporarily applied thereto for deflecting said gate away from said quiescent closed position.

4. The combination of claim 1 wherein said hook means is fabricated of a heavy duty plastic composition.

5. The combination of claim 1 wherein said clasp means is fabricated of a heavy duty metal composition.

* * * * *